US006731055B2

(12) United States Patent
Reed et al.

(10) Patent No.: US 6,731,055 B2
(45) **Date of Patent: *May 4, 2004**

(54) COLOR PICTURE TUBE HAVING A LOW EXPANSION TENSION MASK ATTACHED TO A HIGHER EXPANSION FRAME

(75) Inventors: Joseph Arthur Reed, York, PA (US); Gary Lee Diven, Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 355 days.

This patent is subject to a terminal disclaimer.

(21) Appl. No.: 09/767,076

(22) Filed: Jan. 22, 2001

(65) Prior Publication Data

US 2002/0101149 A1 Aug. 1, 2002

(51) Int. Cl.[7] ..... H01J 29/80
(52) U.S. Cl. ..... 313/407; 313/402
(58) Field of Search ..... 313/402, 403, 313/407, 408

(56) References Cited

U.S. PATENT DOCUMENTS

| | | | | | |
|---|---|---|---|---|---|
| 5,680,004 | A | * | 10/1997 | Ragland, Jr. | 313/405 |
| 5,686,784 | A | * | 11/1997 | Thoms et al. | 313/402 |
| 5,952,774 | A | * | 9/1999 | Diven et al. | 313/402 |
| 6,069,437 | A | * | 5/2000 | Matsuki et al. | 313/407 |
| 6,188,172 | B1 | * | 2/2001 | Matsuki et al. | 313/407 |
| 6,246,164 | B1 | * | 6/2001 | Heyman et al. | 313/407 |

* cited by examiner

*Primary Examiner*—Harshad Patel
(74) *Attorney, Agent, or Firm*—Joseph S. Tripoli; Joseeph J. Laks; Carlos M. Herrera

(57) ABSTRACT

A color picture tube has a tensioned mask supported by a support frame mounted within said tube. The mask has a significantly lower coefficient of thermal expansion than the frame. Intermediary members are located between the mask and the frame. The intermediary members are of a material having a coefficient of thermal expansion similar to that of the mask. Each of the intermediate members is attached to the frame by a plurality of connectors. Each of the connectors is elongated, and each of the connectors is attached at one end thereof to one of intermediate members and attached at an opposite end to said frame.

9 Claims, 3 Drawing Sheets

FIG. 1
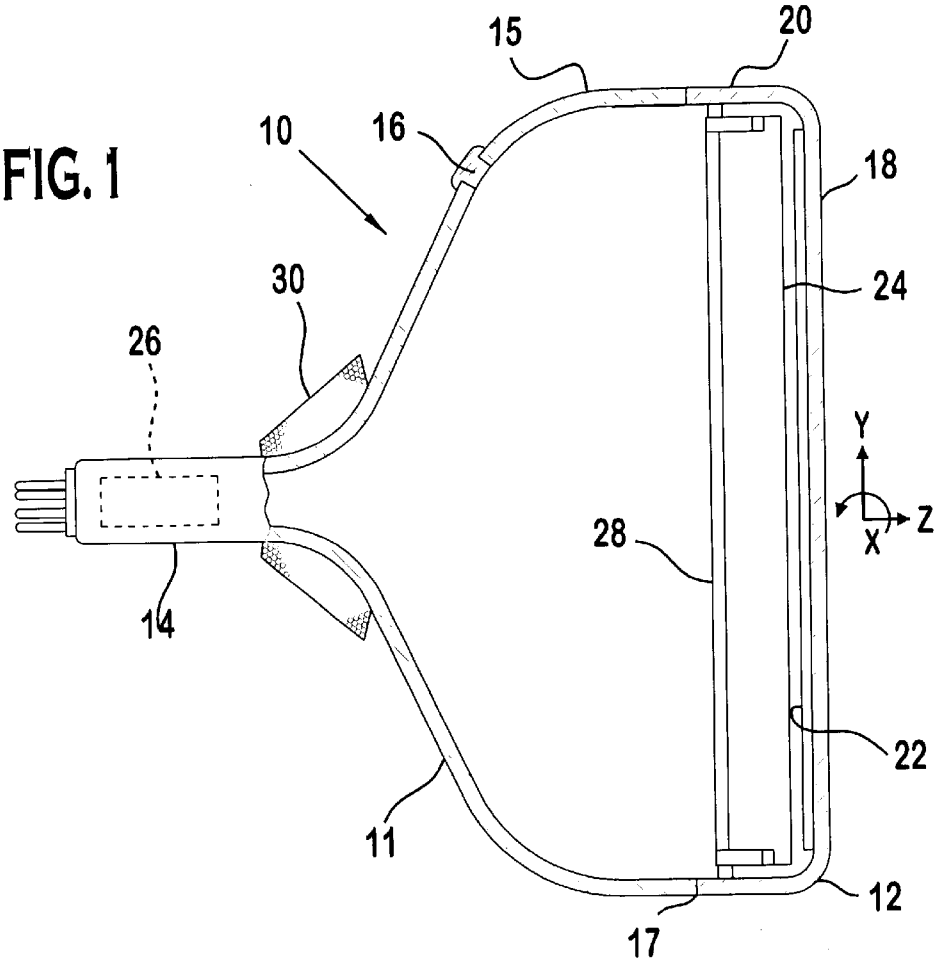
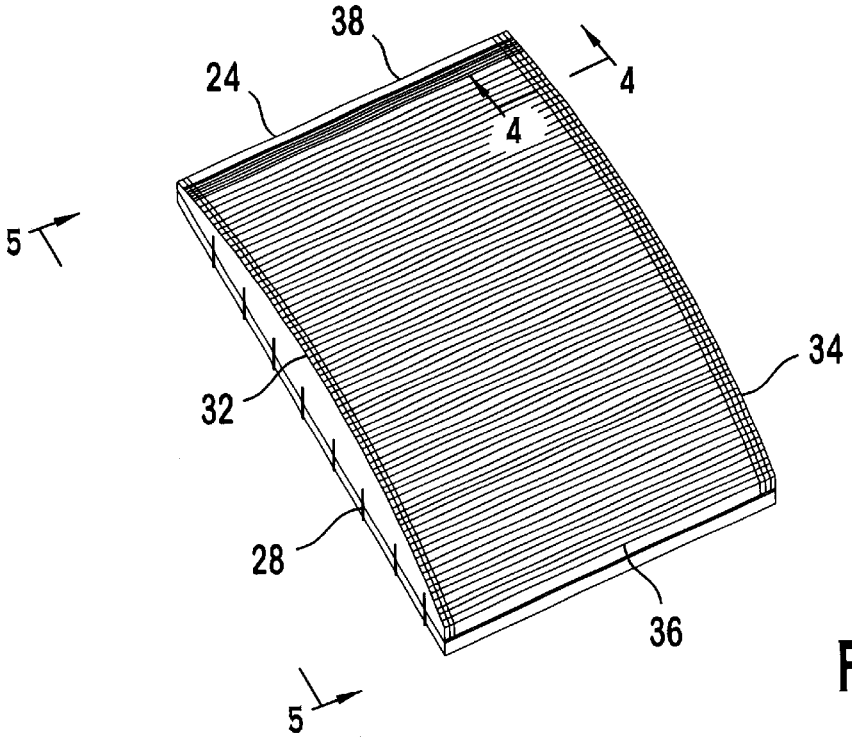
FIG. 2

FIG. 3
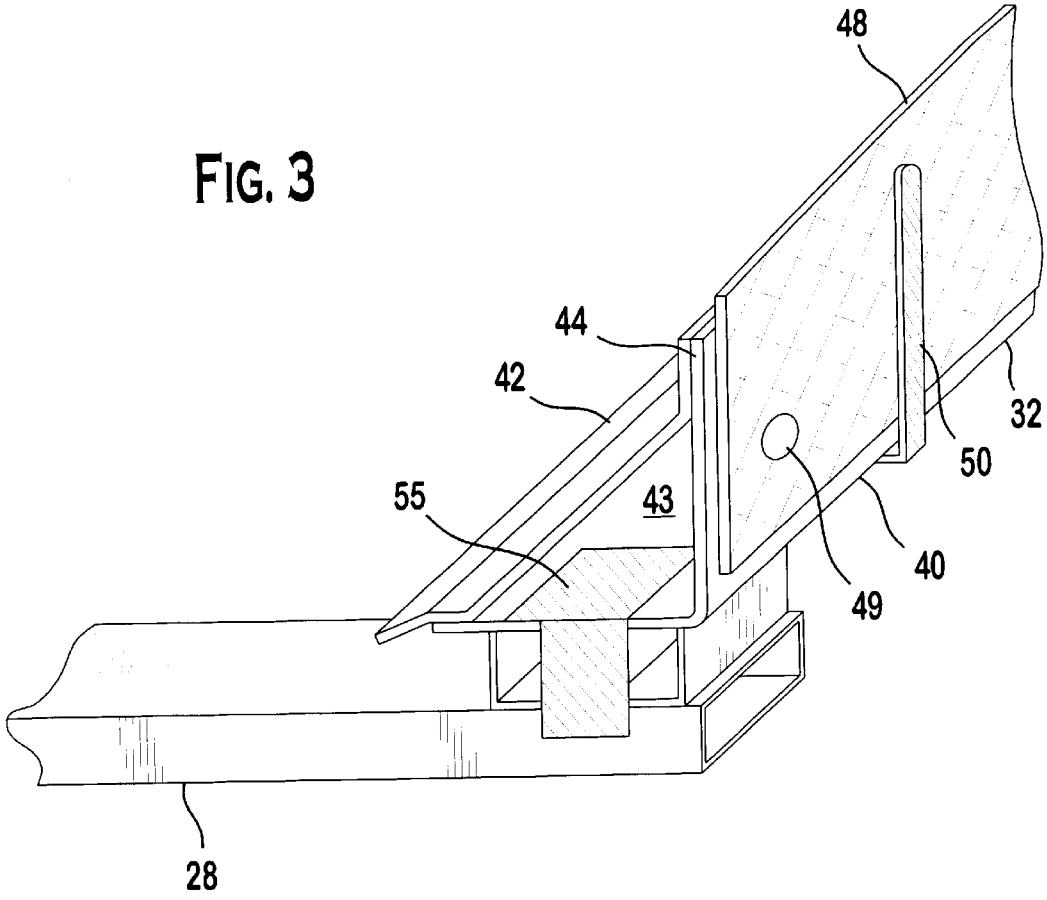
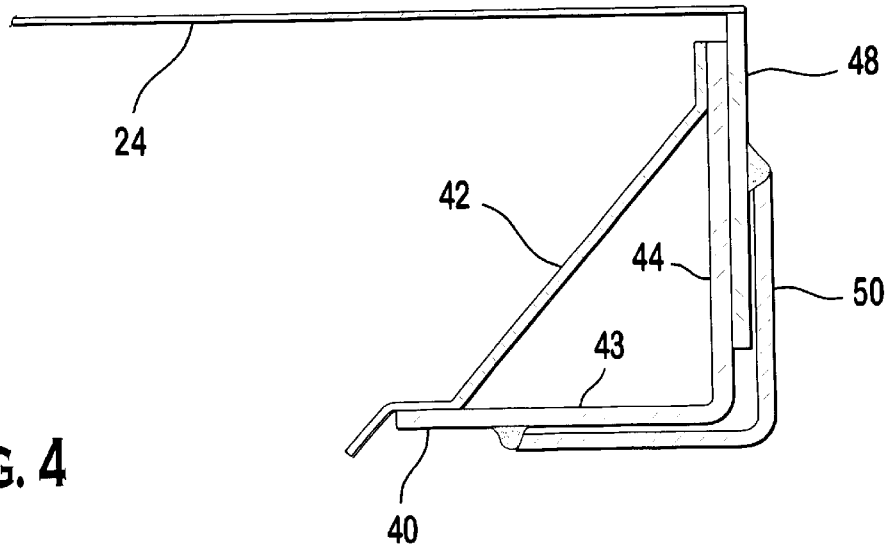
FIG. 4

COLOR PICTURE TUBE HAVING A LOW EXPANSION TENSION MASK ATTACHED TO A HIGHER EXPANSION FRAME

This invention relates to color picture tubes having tension masks, and particularly to a tube having means for connecting a tension mask, that is made of a material having a relatively low coefficient of thermal expansion material, to a support frame, that has a significantly higher coefficient of thermal expansion.

BACKGROUND OF THE INVENTION

A color picture tube includes an electron gun for generating and directing three electron beams to the screen of the tube. The screen is located on the inner surface of a faceplate of the tube and is made up of an array of elements of three different color-emitting phosphors. A color selection electrode, which may be either a shadow mask or a focus mask, is interposed between the gun and the screen to permit each electron beam to strike only the phosphor elements associated with that beam. A shadow mask is a thin sheet of metal, such as steel, that is usually contoured to somewhat parallel the inner surface of the tube faceplate.

One type of color picture tube has a tension mask mounted within a faceplate panel thereof. In order to maintain the tension on the mask, the mask must be attached to a relatively massive support frame. Although such tubes have found wide consumer acceptance, there is still a need for further improvement, to reduce the weight and cost of the mask-frame assemblies in such tubes.

It has been suggested that a lighter frame could be used in a tension mask tube if the required tension on a mask is reduced. One way to reduce the required mask tension is to make the mask from a material having a low coefficient of thermal expansion. However, a mask from such material requires a support frame of a material having a similar coefficient of thermal expansion, to prevent any mismatch of expansions during thermal processing that is required for tube manufacturing, and during tube operation. Because the metal materials that have low coefficients of thermal expansion are relatively expensive, it is costly to make both the mask and frame out of identical or similar low expansion materials. Therefore, it is desirable to use the combination of a low expansion tension mask with a higher expansion support frame, and to provide a solution to the problem that exists when there is a substantial mismatch in coefficients of thermal expansion between a tension mask and its support frame.

SUMMARY OF THE INVENTION

The present invention provides a color picture tube having a tensioned mask supported by a support frame mounted within the tube. The mask has a significantly lower coefficient of thermal expansion than the frame. Intermediate members are located between the mask and the frame. The intermediate members are of a material having a coefficient of thermal expansion similar to that of the mask. Each of the intermediate members is attached to the frame by a plurality of connectors. Each of the connectors is elongated, and each of the connectors is attached at one end thereof to one of the intermediate members and attached at an opposite end to the frame.

BRIEF DESCRIPTION OF THE DRAWINGS

In the drawings:

FIG. 1 is a side view, partly in axial section, of a color picture tube embodying the invention.

FIG. 2 is a perspective view of a tension mask-frame assembly.

FIG. 3 is a partial perspective view of the mask-frame assembly of FIG. 2.

FIG. 4 is a cross-sectional view of the mask-frame assembly taken at line 4—4 of FIG. 2.

DETAILED DESCRIPTION OF THE PREFERRED EMBODIMENTS

Figure 5:
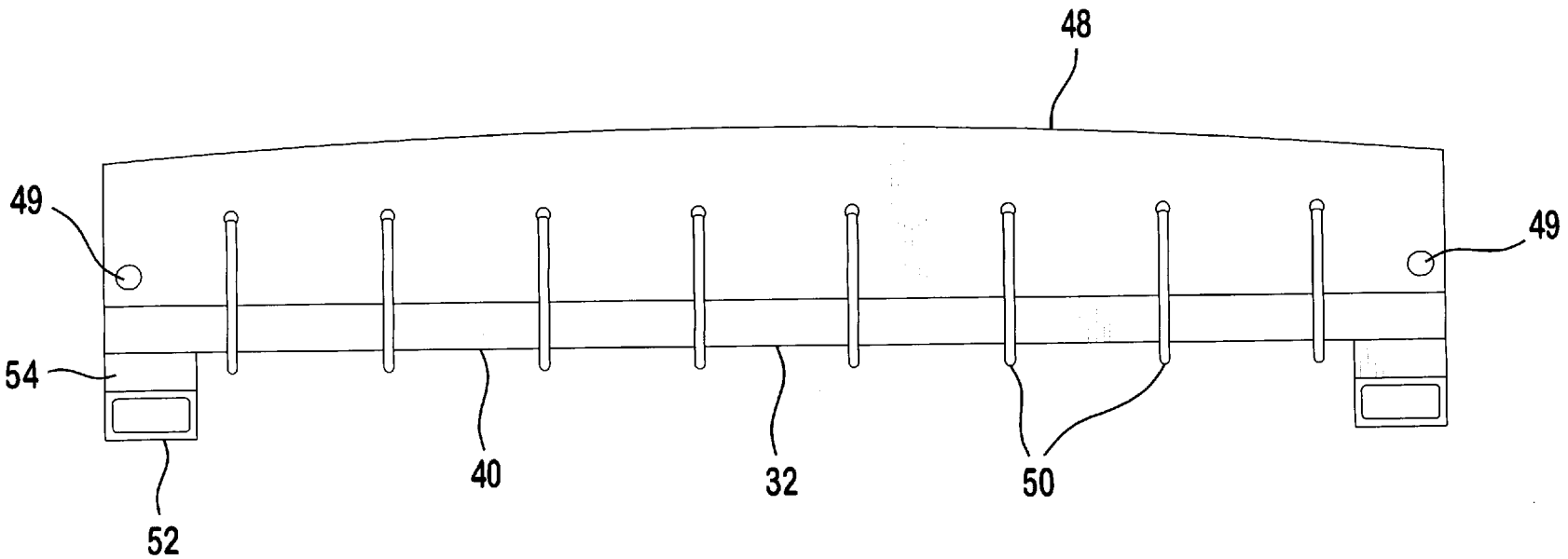
FIG. 5 is a front view of the mask-frame assembly taken at line 5—5 of FIG. 2.

FIG. 1 shows a color picture tube 10 having a glass envelope 11 comprising a rectangular faceplate panel 12 and a tubular neck 14 connected by a funnel 15. The funnel 15 has an internal conductive coating (not shown) that extends from an anode button 16 toward the panel 12 and to the neck 14. The panel 12 comprises a substantially cylindrical or flat viewing faceplate 18 and a peripheral flange or sidewall 20, which is sealed to the funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tension mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

The tension mask 24, as shown in FIG. 2, is interconnected to a peripheral frame 28 that includes two long sides 32 and 34, and two short sides 36 and 38. The two long sides 32 and 34 of the frame parallel a central major axis, X, of the tube; and the two short sides 36 and 38 parallel a central minor axis, Y, of the tube. The tension mask 24 includes an apertured portion that contains a plurality of metal strips having a multiplicity of elongated slits therebetween that parallel the minor axis of the mask.

As shown in greater detail in FIGS. 3 and 4, each of the two long sides 32 and 34 (not shown) of the frame 28 includes an L-shaped section 40 having an inner flange 43 and an outer flange 44. A slanted section 42 extends between the two flanges, of the L-shaped section 40 to form a triangular cross-section. An intermediate member 48, as shown in FIGS. 3, 4, and 5, is movably attached to the outer flange 44 of each L-shaped section 40. Each intermediate member 48 extends the length of a long side, 32 and 34, and overlaps the outer flange 44. The intermediate members 48 are slidably affixed to the outer flanges 44 of the frame 28 by rivets 49 that are located at each end of the intermediate members 48. The rivets 49 are attached to the outer flanges 44, but ride in elongated slot apertures in the intermediate members 48. The purpose of the rivets is to keep the intermediate member 48 in contact with the frame 28 and to limit any twisting motion of the intermediate member relative to the frame. Also interconnecting the intermediate members 48 to the frame 28 are a plurality of elongated connectors 50 that extend from the outer surface of the intermediate members 48 to a surface of the inner flanges 43. Opposite ends of the elongated connectors 50 are welded to the frame 28 and to the intermediate member 48, respectively. The intermediate members 48 are of a material that has a low coefficient of thermal expansion similar to that of the mask 24. Therefore, changes of temperature that cause the mask to expand will have little effect on the position of the mask 24 relative to the intermediate members 48. For example, a mask having a low coefficient of thermal expansion attached without a like intermediate member will become excessively stretched in the tube major axis direction during tube assembly, and permanent wrinkles will develop in the mask. Also, an intermediate member having a low coefficient of thermal expansion attached without a plurality of elongated connectors will cause an uncorrectable warping of the frame and mask during tube operation, which will distort the displayed image.

The short sides 36 and 38 of the frame 28 are tubes 52 having rectangular cross-sections. The ends of the tubes 52 are interconnected to the ends of the inner flanges 43 through four stand-off sections 54. Angled mounting brackets 55 are attached to the frame 28 and are located at the four corners of the frame.

In one embodiment, the side tubes 52, the stand-off sections 54, the L-shaped sections 40 and the slanted section 42 are made from 4130 steel and the intermediate members 48 are of Invar. The side tubes 52 are 2.54 cm by 1.27 cm and 1.24 mm thick (1"×½" and 0.049"). The stand-off sections 54 are 1.59 cm by 1.59 cm and 1.52 mm thick (⅝"×⅝" and 0.060"). The L-shaped sections 40 and the slanted sections 42 are 1.27 mm (0.050") thick. The intermediate members 48 are 3.05 mm (0.120") thick. The spacing between the connectors 50 is about 5.08 cm (2.0"). In general, thicknesses of the component parts of the complete frame assembly are determined by considering mask thickness, the flexibility of the total mask-frame assembly and the desired warp misregistration limits.

In most embodiments, all of the connectors 50 can be of the same material. However, there are other embodiments where the connectors 50 are made of different materials, shapes or sizes to accommodate masks, frames and intermediate members of differing constructions.

Although the short sides of the frame have been shown as hollow rectangular tubes, other preferred configurations, such as those having L-shaped, C-shaped or triangular-shaped cross-sections, are also possible for these sides. Furthermore, although the long sides of the frame 28 have been shown as having triangular cross-sections formed from L-shaped sections 40 and slanted sections 42, other configurations also may be used, such as C-shaped or L-shaped.

What is claimed is:

1. A color picture tube having a tension mask supported by a support frame mounted within said tube, including said mask having a significantly lower coefficient of thermal expansion than said frame, intermediate members located between said mask and said frame, said intermediate members being of a material having a coefficient of thermal expansion similar to that of said mask, each of said intermediate members being attached to said frame by a plurality of connectors, each of said connectors being elongated, and each of said connectors being attached at one end thereof to one of said intermediate members and being attached at an opposite end to said frame.

2. The color picture tube as defined in claim 1, wherein said connectors are rigid wires that are welded to both said intermediate members and said frame.

3. The color picture tube as defined in claim 1, wherein said mask is made from Invar and said frame is made from steel.

4. A color picture tube, comprising:

a frame mounted within said tube and having two longer sides connected by two shorter sides defining a rectangular opening therebetween;

a tension mask disposed over said opening and supported by said frame, said tension mask having a coefficient of thermal expansion significantly lower than said frame; and an intermediate member extending along each long side of said frame and affixed in sliding contact with said frame to accommodate thermal expansion of said frame.

5. The color picture tube of claim 4 wherein said intermediate member comprises an elongated slot, and wherein a rivet is affixed to said long side of said frame riding in said elongated slot to maintain contact between said frame and said intermediate member.

6. The color picture tube of claim 4 wherein said long side of said frame comprises an outer flange at the periphery of said frame and an inner flange extending from said outer flange toward said opening.

7. The color picture tube of claim 6 further comprising a plurality of elongated connectors, each fastened at one end thereof to said intermediate member at an opposite end to said inner flange.

8. The color picture tube of claim 4 wherein said intermediate member extends the length of said long side of said frame.

9. A color picture tube, comprising:

a support frame mounted within said tube, at least a portion of said frame comprising an outer flange and an inner flange;

a tension mask supported by said frame, said mask having a significantly lower coefficient of thermal expansion than said frame;

intermediate members located between said mask and said frame, said intermediate members formed of a material having a coefficient of thermal expansion similar to that of said mask; and first and second connectors affixing said intermediate members to said frame, said first connectors slidably affixing said intermediate member to said outer flange and said second connectors being elongate wires affixed at one end thereof to said intermediate member and at an opposite end to said inner flange.

* * * * *